US005653318A

United States Patent [19]

Field

[11] Patent Number: 5,653,318

[45] Date of Patent: Aug. 5, 1997

[54] DETACHABLE HARD-SHELL BOTTOM FOR SOFT-SIDED MEDICAL KITS

[76] Inventor: Bradley J. Field, 585 Gaston Avenue, Kelowna, B.C., Canada, V1Y 7E6

[21] Appl. No.: 492,719

[22] Filed: Jun. 20, 1995

[30] Foreign Application Priority Data

Dec. 22, 1994 [CA] Canada ..... 2138849

[51] Int. Cl.[6] ..... A45C 13/00; A45C 13/36; A65D 30/16; A65D 33/02

[52] U.S. Cl. ..... 190/18 R; 190/111; 190/127; 383/119; 383/121.1; 206/570

[58] Field of Search ..... 190/18 R, 100, 190/18 A, 111, 127; 249/96–98; 206/315.4, 315.7, 570; 303/119, 121, 121.1

[56] References Cited

U.S. PATENT DOCUMENTS

| | | | |
|---|---|---|---|
| 1,384,078 | 7/1921 | May | 206/315.7 |
| 1,521,310 | 12/1924 | Moran | 190/108 X |
| 1,731,547 | 10/1929 | Stansbury | 190/18 R |
| 1,811,296 | 6/1931 | Boden et al. | 248/96 |
| 2,275,297 | 3/1942 | Hearnshaw | 206/315.7 X |
| 2,904,295 | 9/1959 | Patterson | 248/97 |
| 3,901,299 | 8/1975 | Picco | 206/315.4 |
| 4,249,586 | 2/1981 | Setani | 206/315.4 |
| 4,270,590 | 6/1981 | Marshall | 190/100 |
| 4,301,898 | 11/1981 | Plough et al. | 190/52 |
| 4,513,866 | 4/1985 | Thomas | 206/570 |
| 4,596,397 | 6/1986 | Conti | 248/98 X |
| 5,090,526 | 2/1992 | Jacober | 190/107 |
| 5,307,908 | 5/1994 | Shyr et al. | 190/111 X |

*Primary Examiner*—Sue A. Weaver
*Attorney, Agent, or Firm*—Bishop & Company

[57] ABSTRACT

A hard-shell bottom for releasable attachment to a soft-sided carrying case has a lower exterior surface comprising a fluid impermeable base platform having a lower surface and substantially vertical side surfaces contiguous to the lower surface and extending continuously around the lower surface so as to form a container having interior surfaces. The lower surface is sized to correspond in shape to the lower exterior surface of the soft-sided carrying case and the side surfaces sized to snugly fit over side portions of the lower exterior surface of the soft-sided carrying case. The releasable fasteners are attached to at least one surface of the interior surfaces for releasable mating securement to corresponding releasable fasteners means attached to the lower exterior surface of the soft-sided carrying case.

6 Claims, 1 Drawing Sheet

DETACHABLE HARD-SHELL BOTTOM FOR SOFT-SIDED MEDICAL KITS

FIELD OF THE INVENTION

The invention relates to the field of soft-sided medical kits and, in particular, soft-sided medical kits having detachable hard-shell bottoms.

BACKGROUND OF THE INVENTION

Soft-sided emergency medical kits are widely used by paramedics, search and rescue and the like. One drawback, however, of conventional soft-sided kits is that they may absorb fluids such as blood or battery acid, fluids often found in the vicinity of automobile accidents. Typical soft-sided kits exposed to such fluids must thus be cleaned thoroughly for re use or discarded.

Another drawback of conventional soft-sided kits is that because they are soft-sided, they tend to wear out. Further, it has been found that soft-sided medical kits which have side pockets extending from the body of the kit, can be unstable and prone to tipping over when the side pockets are heavily laden. Consequently, it is the object of the invention to provide a hard-shell detachable bottom for such soft-sided medical kits. Apart from adding stability to the soft-sided kit and providing a liquid impervious shield for when the kit is placed on the ground, the further object of the invention is to provide a simple yet effective mechanism for releasably mounting the hard-shell bottom to the bottom of soft-sided kits so as to removably yet securely hold the hard-shell bottom in place.

In particular, it is an object of the present invention to provide releasable fastening of the hard-shell bottom of the present invention to the bottom of soft-sided kits which releasable fastening relies on the additional fastening strength of conventional hook and loop fasteners when the surfaces to be detached have to be sheared apart rather than the more conventional peeling of one side of the hook and loop fastener from the other. Consequently, it is an object of the invention to provide hook and loop fastening between vertical sides of the hard-shell bottom of the present invention and vertical sides of the soft-sided kit so as to vertically mate counterpart hook and loop strips.

In the prior art, Applicant is aware of U.S. Pat. No. 5,090,526 which issued to Jacober on Feb. 25, 1992 for a self-supporting, selectively collapsible soft-walled carrier. Jacober discloses a soft-walled carrier 10 including a removable end panel insert 32 that provides additional support.

Applicant is also aware of the U.S. Pat. No. 4,301,898 which issued to Plough et al. on Nov. 24, 1981 for a peace officer's equipment bag. Plough et al. teaches vertical Velcro (TM) fasteners 42 and 40 whereby flap 39 may be secured to the equipment bag. Similarly, U.S. Pat. No. 4,513,866 which issued to Thomas on Apr. 30, 1985 for an emergency medical pack teaches the use of fasteners 46 onto which hook and loop fasteners are attached.

Neither Jacober, Plough et al., nor Thomas teach nor suggest, whether taken solely or in combination, the device of the present invention, the objects of which are set out above and as hereinafter more fully described.

SUMMARY OF THE INVENTION

A hard-shell bottom for releasable attachment to a soft-sided carrying case has a lower exterior surface having a fluid impermeable base platform and the base platform has a lower surface and substantially vertical side surfaces contiguous to the lower surface and extending continuously around the lower surface so as to form a container having interior surfaces. The lower surface is sized to correspond in shape to the lower exterior surface of the soft-sided carrying case. The side surfaces are sized to snugly fit over side portions of the lower exterior surface of the soft-sided carrying case and the releasable fastening means attached to at least one of the side surfaces forming the interior surfaces of the container for releasable mating securement to corresponding releasable fastening means attached to the lower exterior surface of the side surfaces on the soft-sided carrying case.

The releasable fastening means may be hook and loop fasteners.

The base platform further comprises substantially horizontal side flange members rigidly attached to, and extending substantially horizontally from, the base platform, whereby the side flange members may support the soft-sided carrying case when releasably attached to the base platform.

The side flange members further comprises stabilizing means extending from the side flange members to thereby aid the base platform in holding upright the soft-sided carrying case when mounted on the base platform.

Advantageously, the releasable fastening means are hook and loop fasteners. The base platform may also have substantially horizontal side flange members rigidly attached to, and extending substantially horizontally from the base platform, whereby the side members may support the soft-sided carrying case, or at least side pocket thereof, when the soft-sided carrying case is releasable attached to the base platform.

The side flange members may further have stabilizing devices extending from the side flange members so as to thereby aid the base platform in holding upright the soft-sided carrying case when the soft-sided carrying case is mounted on the base platform.

Further advantageously, the releasable fastening means attached to at least one surface of the interior surfaces of the base platform are strips of hook and loop fasteners attached to the interior side walls of the base platform container formed by the lower surface and vertical side surfaces.

DETAILED DESCRIPTION OF THE PREFERRED EMBODIMENT

Figure 1:
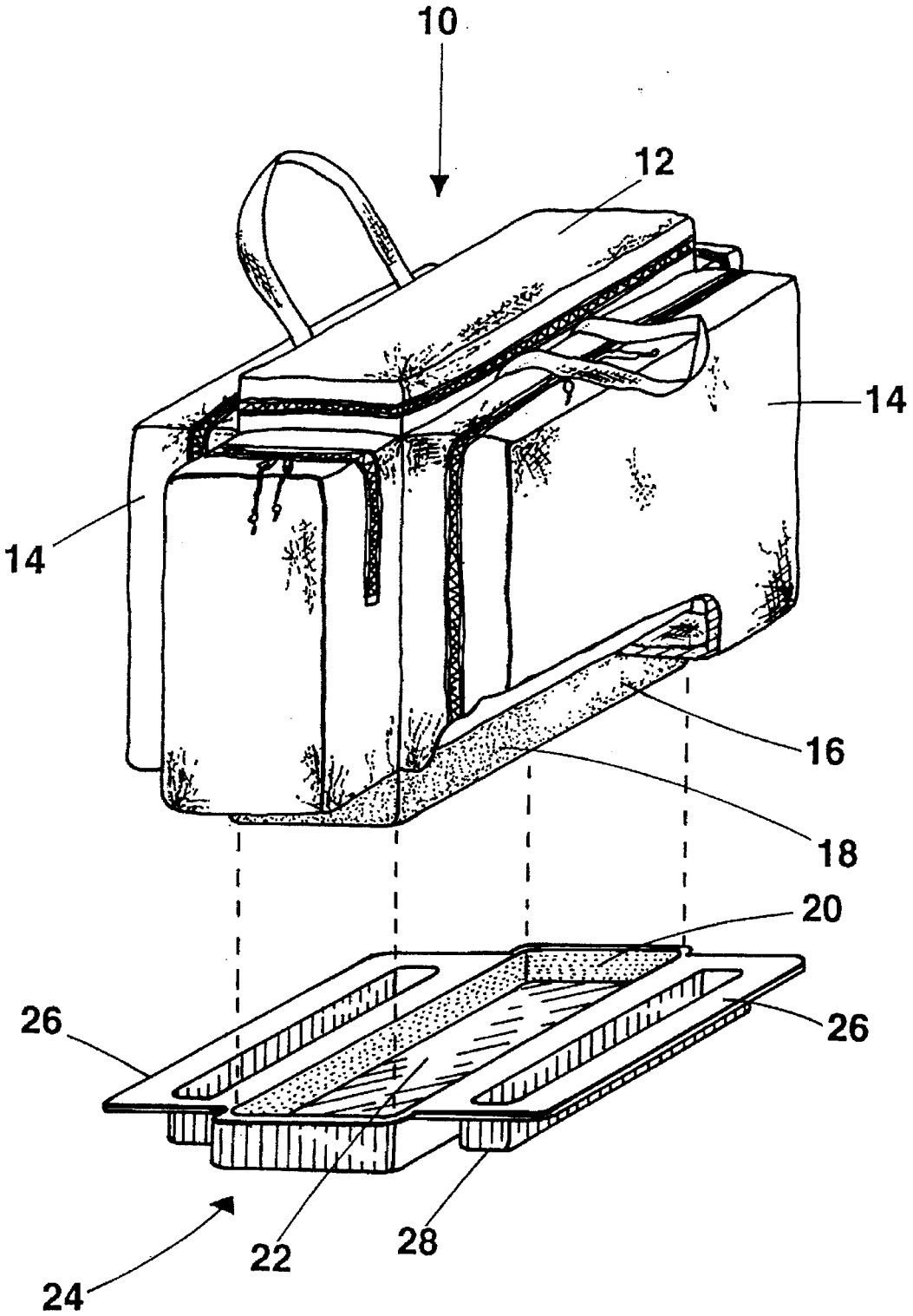
FIG. 1 is an exploded perspective view of a soft-sided medical kit and the hard-shell bottom of the present invention.

As illustrated in FIG. 1, soft-sided medical kit 10 has main compartment 12, side compartments 14and soft-sided base 16. Mounted contiguously around the circumference of base 16 are fastener strips 18 which may be strips of hook and loop fastener such as sold under the trademark Velcro.

Corresponding mating fastener strips 20 are mounted contiguously around the interior of trough 22 formed longitudinally in hard-shell bottom 24. Trough 22 is shaped to snugly conformally fit over base 16 so as to bring fastener strips 18 and corresponding fastener strips 20 into releasable mating engagement.

Hard-shell bottom 24 may have longitudinal horizontal platform members 26 extending horizontally from the longitudinal sides of trough 22 so as to support side compartments 14 when side compartments 14 are heavily laden. Platform members 26 may have means for stabilizing hard-shell bottom 24 from tipping over in the event one of side compartments 14 is heavily laden and the other is not, which stabilizing means may, as illustrated, take the form of an outrigger arrangement longitudinally along platform members 26.

Thus, as depicted in FIG. 1, platform members 26 have formed therein longitudinal depressions 28 which act to structurally strengthen platform members 26 and stabilize hard-shell bottom 24 from tipping over. Other forms of stabilizers such as feet depending from platform members 26 may also be used.

In a preferred embodiment, hard-shell bottom 24 may be made of corrosive resistant high density polyethylene.

If fastener strips 18 and corresponding fastener strips 20 are strips of hook and loop type fasteners, then in order to strengthen the releasable securement between soft-sided medical kit 10 and hard-shell bottom 24, fastener strips 18 and corresponding fastener strips 20 should be arranged for vertical mating engagement. Thus, the sides of trough 22 would be vertical for snug mating over corresponding vertical sides on base 16.

To release hard-shell bottom 24 from base 16, rather than pealing corresponding hook and loop fastener strips apart as taught in the prior art, inadvertent separation of hard-shell bottom 24 from soft-sided medical kit 10 will require shearing separation between fastener strips 18 and corresponding fastener strips 20. In this manner, Applicant has obtained more effective retention of hard-shell bottom 24 against the underside of soft-sided medical kit 10.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A hard-shell bottom for releasable attachment to a soft-sided medical carrying case having a lower exterior surface and side pouches mounted to, and extending from sides of said soft-sided carrying case, comprising:

a fluid impermeable base platform impermeable to corrosive fluids, said base platform having a lower surface and substantially vertical side surfaces contiguous to said lower surface and extending continuously around said lower surface so as to form a container having interior surfaces, said lower surface sized to correspond in shape to said lower exterior surface of said soft-sided carrying case, said side surfaces sized to snugly fit over generally vertical side portions of said lower exterior surface of said soft-sided carrying case, releasable fastening means attached to at least one of said side surfaces forming said interior surfaces of said container for releasable mating securement to corresponding releasable fastening means attached to said side portions of said lower exterior surface on said soft-sided carrying case, wherein said base platform further comprises substantially horizontal generally planar shelf-like side flange members rigidly attached to, and extending substantially horizontally from said base platform for supporting in resting engagement thereon, said side pouches when said soft-sided carrying case is releasably attached to said base platform.

2. The device of claim 1 wherein said releasable fastening means are hook and loop fasteners.

3. The device of claim 1 wherein said side flange members further comprise stabilizing means extending from said side flange members to thereby aid said base platform in holding upright said soft-sided carrying case when mounted on said base platform.

4. The device of claim 3 wherein said stabilizing means are longitudinally extending outrigger-like stabilizers.

5. The device of claim 3 wherein said stabilizing means are longitudinal depressions formed in said side flange members and extending downwardly of said side flange members into proximity with a surface on which said base platform is rested.

6. The device of claim 1 wherein said side flange members are rigidly mounted to upper edges of said side surfaces.

* * * * *